United States Patent [19]

Deschamps et al.

[11] Patent Number: 4,519,895

[45] Date of Patent: May 28, 1985

[54] PROCESS FOR CONVERTING A CARBONACEOUS MATERIAL TO LOWER PARAFFINIC HYDROCARBONS AND MONOCYCLIC AROMATIC HYDROCARBONS

[75] Inventors: André Deschamps, Noisy le Roi; Sigismond Franckowiak, Rueil-Malmaison, both of France

[73] Assignee: Institut Francais du Petrole, Rueil-Malmaison, France

[21] Appl. No.: 444,016

[22] Filed: Nov. 23, 1982

[30] Foreign Application Priority Data

Nov. 23, 1981 [FR] France ..... 81 22018

[51] Int. Cl.[3] ..... C10G 1/00; C10G 1/06

[52] U.S. Cl. ..... 208/8 LE; 208/10

[58] Field of Search ..... 208/8 LE, 10

[56] References Cited

U.S. PATENT DOCUMENTS

| | | | |
|---|---|---|---|
| 3,644,192 | 2/1972 | Li et al. | 208/8 LE |
| 3,855,070 | 12/1974 | Squires | 208/8 R |
| 4,013,543 | 3/1977 | Greene | 208/8 |
| 4,085,030 | 4/1978 | Green et al. | 208/8 R |
| 4,123,347 | 10/1978 | Maa | 208/8 LE |
| 4,141,794 | 2/1979 | Choi | 208/8 R |
| 4,162,959 | 7/1979 | Duraiswamy | 208/8 R |
| 4,166,786 | 9/1979 | Duraiswamy et al. | 208/8 R |
| 4,190,518 | 2/1980 | Giannetti et al. | 208/8 LE |
| 4,219,402 | 8/1980 | De George | 208/8 LE |
| 4,225,414 | 9/1980 | Duncan | 208/8 R |
| 4,229,185 | 10/1980 | Foss | 208/8 R X |
| 4,272,501 | 6/1981 | Greskovich et al. | 208/8 LE X |
| 4,313,816 | 2/1982 | Veluswamy et al. | 208/8 LE X |
| 4,328,088 | 5/1982 | Anderson et al. | 208/10 X |
| 4,379,744 | 4/1983 | Rosenthal et al. | 208/10 |

FOREIGN PATENT DOCUMENTS

| | | | |
|---|---|---|---|
| 2057493 | 4/1981 | United Kingdom | 208/10 |

*Primary Examiner*—William G. Wright

*Attorney, Agent, or Firm*—Millen & White

[57] ABSTRACT

A carbonaceous material is subjected, in admixture with a hydrogenated recycle oil, to hydrogenation in two successive steps at respective temperature ranges of 350°-470° C. and 600°-1000° C., under a pressure of at least 20 bars, the resulting product being separated into a carbonaceous solid residue, which is subsequently treated with oxygen and steam so as to obtain a hydrogen-containing reducing gas to be used in the second of the two hydrogenation steps, a fraction distilling in major part above 150° C. which, after hydrogenation, forms the recycle oil admixed with the starting carbonaceous material, and a fraction containing the desired lower paraffinic hydrocarbons and monocyclic aromatic hydrocarbons, distilling in major part below 150° C.

15 Claims, 2 Drawing Figures

PROCESS FOR CONVERTING A CARBONACEOUS MATERIAL TO LOWER PARAFFINIC HYDROCARBONS AND MONOCYCLIC AROMATIC HYDROCARBONS

BACKGROUND OF THE INVENTION

This invention concerns a process for producing fluid (gaseous and liquid) hydrocarbons by hydropyrolysis of solid carbonaceous materials such as coal, lignite or peat.

The oldest process for treating these raw materials in order to obtain liquid or gaseous hydrocarbons is pyrolysis. This technique suffers from the disadvantages of a low yield of fluid hydrocarbons, poor quality, and a high yield of solid residue difficult to upgrade except in the case of foundry coke.

Numerous improvements to this basic principle have been proposed.

First of all, it has been proposed to improve the quality of hydrocarbons produced by pyrolysis by means of catalytic hydrogenation.

An improvement of the quality and the yield of fluid hydrocarbons has also been claimed, resulting from the use of a quick heating of the carbonaceous material (flash pyrolysis) followed with quenching in order to avoid the polymerization of the formed unsaturated hydrocarbons. U.S. Pat. Nos. 4,085,030, 4,141,794 and 4,229,185 describe a manner of using such a technique by contacting the carbonaceous material with a recycled solid residue previously heated by partial combustion.

Finally, it has been shown that the presence of hydrogen under pressure, in the course of a quick pyrolysis (flash hydropyrolysis) of the carbonaceous material, substantially decreases the amount of solid residue and provides higher proportions of light aliphatic and aromatic hydrocarbons. Many patents describe various modes of application of this technique. Thus, the quick heating of the carbonaceous material may be obtained by preheating the hydrogen stream in an oven, or by injecting oxygen into the hydrogen stream, as described in U.S. Pat. Nos. 3,960,700 and 4,225,414, or by recycling solid residue previously heated by partial combustion, as indicated in U.S. Pat. No. 3,855,070. This solid residue may also be used to manufacture hydrogen by reaction with steam, as indicated in U.S. Pat. Nos. 4,162,959 and 4,166,786.

In spite of all these improvements, the yields of fluid hydrocarbons remain low, particularly the yield of monocyclic aromatic hydrocarbons, such as benzene, toluene and xylenes (BTX), which have the greatest commercial value.

Thus, in the case of coals, the yields of liquid product range from 5 to 15% by weight of the initial carbonaceous material, whereas the production of solid residue is never lower than 40% and, in most cases, between 50 and 60%. In addition, the technological solutions to the problem of a rapid heating of the coal charge are costly and/or power consuming.

SUMMARY OF THE INVENTION

The process of the invention avoids these drawbacks and makes possible the conversion with a high yield of a solid carbonaceous material such as coal, to light hydrocarbons, particularly methane, ethane and monocyclic aromatic hydrocarbons.

The process comprises the following steps:

(a) the carbonaceous material is admixed with a hydrogenated recycle oil having an atomic ratio H/C of at least 1/1, obtained in step (f), and the resulting mixture is maintained in contact with a hydrogen-containing gas at a temperature from 350° to 470° C., for at least 5 minutes, under a partial hydrogen pressure of at least 20 bars;

(b) the product from step (a) is treated for 0.1 to 60 seconds with a hydrogen-containing reducing gas, at a temperature from 600° to 1000° C. under a pressure of at least 20 bars, said reducing gas being produced at least partly in step (d) and being introduced at a temperature of at least 900° C.;

(c) the product from step (b) is fractionated so as to recover separately (i) at least one fraction of carbonaceous solid residue, (ii) at least one fraction of lower paraffinic hydrocarbons and monocyclic aromatic hydrocarbons normally distilling, at least in major part, below 150° C., and (iii) at least one hydrocarbon fraction normally distilling, at least in major part, above 150° C.;

(d) the fraction (i) of carbonaceous solid residue is treated with oxygen and steam under the conditions of oxyvapogasification of carbon, so as to convert it, at least partly, to a hydrogen-containing reducing gas and at least a part of said reducing gas is fed to step (b) at a temperature of at least 900° C.;

(e) the hydrocarbon fraction (iii) of step (c) is treated with hydrogen, in the presence of a hydrogenation catalyst, under hydrogenation conditions, so as to obtain an atomic ratio H/C of the hydrocarbons of said fraction of at least 1/1; and (f) at least a portion of the hydrogenated hydrocarbon fraction obtained in step (e) is fed back to step (a) as hydrogenated recycle oil.

DETAILED DISCUSSION

This process offers several advantages as compared with the prior art techniques.

Figure 1:
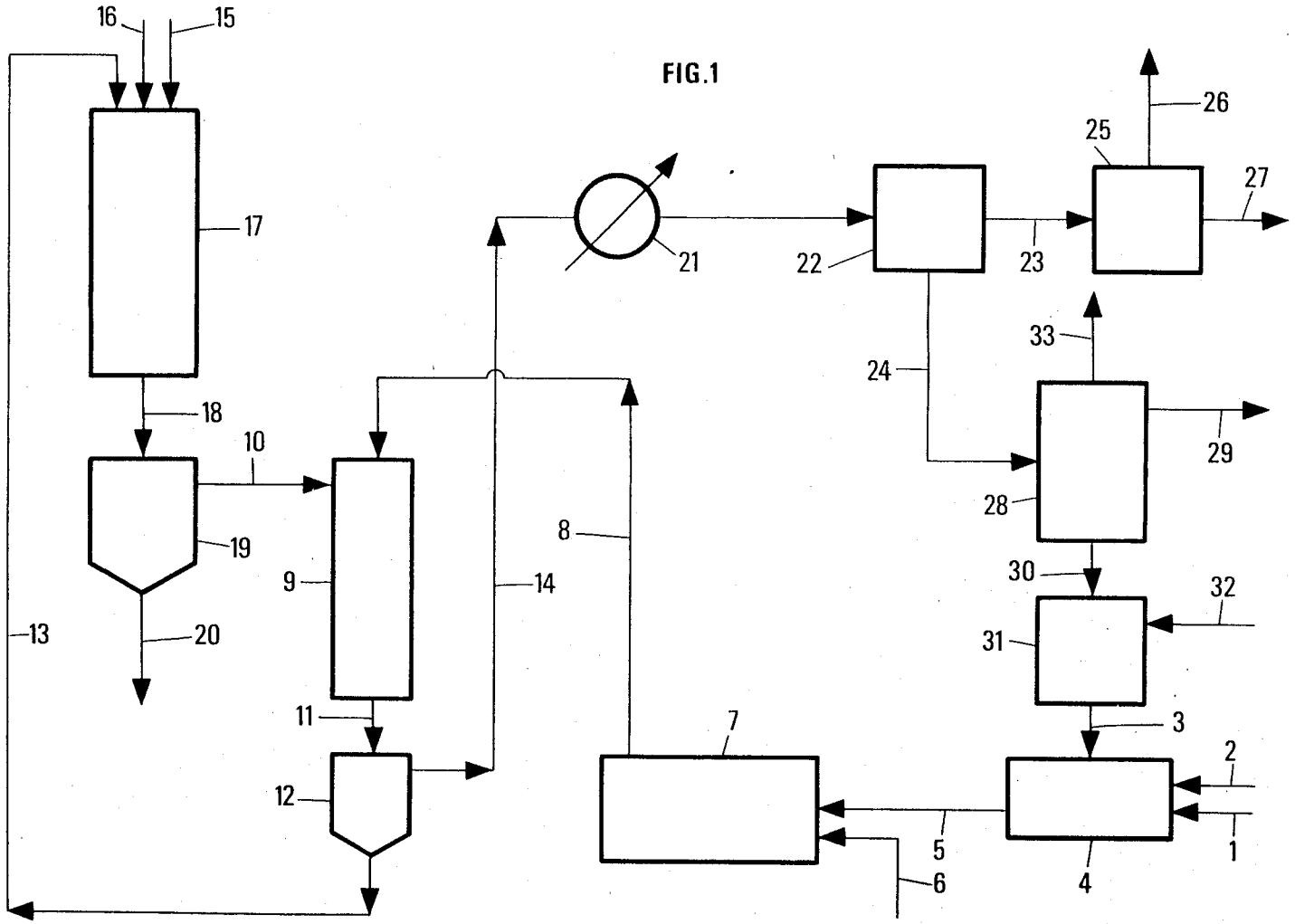
FIG. 1 is a schematic diagram of one embodiment of the process of the invention.

Thus, the fact of making use, in the hydropyrolysis step (b) and also optionally in the preheating step (a), of the raw reducing gas issued from the residue gasification zone (d), instead of hydrogen, avoids the steps, requiring costly investments and power consumption, of converting the CO of said gas by means of steam and of purifying the hydrogen. In addition, the sensible heat contained in the reducing gas issued from the gasifier at a temperature from 900° to 1500° C. is used to bring to the desired temperature the coal charge and the recycle oil in the hydropyrolysis reactor, thereby solving the problem of rapid heating of the charge with a minimum expense of investment and power. Finally, the recycling, after hydrogenation, of the heavy fraction of the produced hydrocarbons, makes it possible to noticeably decrease the amount of solid residue formed in the hydropyrolysis step and to obtain with a high yield light hydrocarbons, particularly methane, ethane and benzene. A more detailed description of the process of the invention, illustrated by the diagram of FIG. 1, is given hereinafter by way of a non-limitative example of an embodiment thereof.

Finely crushed coal is introduced through line 1 into mixer 4 simultaneously with a hydrogenated recycle oil (line 3). A powdered catalyst, although not required, may also be introduced through line 2. The ratio by weight $$\frac{\text{recycle oil}}{\text{coal}}$$

depends on the severity of the hydropyrolysis step since, according to the preferred operating manner, at least 50% and preferably all the produced hydrocarbons of a boiling point higher than 150° C. are recycled. This ratio is usually comprised between 0.5 and 5, preferably between 0.8 and 2.

The suspension is then fed through line 5 to a preheater 7 with an additional amount of hydrogen or raw reducing gas issued from the gasification zone, introduced through line 6. The resulting mixture is brought to a temperature from 350° to 470° C., preferably from 420° to 460° C., under a pressure of at least 20 bars, for example from 20 to 200 bars, for a time which may vary within a wide range, for example between 5 and 120 minutes.

This operation which has a similarity with the known technique of coal hydroliquefaction in the presence of a hydrogen donor solvent, has the effect of preheating the charge of the hydropyrolysis reactor and also to effect the depolymerization and dissolution of a portion of the coal and a certain hydrocracking of its constituents under non-coking conditions. It is advantageous to proceed under the highest possible pressure. However, the integration of this step in the whole process generally leads to an operation at a pressure close to or slightly higher than that of the next hydropyrolysis step. The use of a hydrogenation catalyst, introduced through line 2, is also favorable. Although all the compounds known for their hydrogenating properties, such as vanadium, tungsten, molybdenum, iron, cobalt and/or nickel, can be used, iron-containing compounds, such as iron oxides, sulfides and sulfates which, in view of their low production cost, do not need to be recycled, are preferred.

The preheated gas-liquid-solid mixture is fed, without separation, through line 8 into the hydropyrolysis reactor 9, containing the raw reducing gas introduced through line 10 at a temperature from 900° to 1500° C. This reactor operates preferably under autothermal conditions at a temperature from 600° to 1000° C., preferably from 650° to 800° C. under a pressure from 20 to 150 bars. The temperature may be maintained within the desired range by regulation of the temperature and feeding rates. Different types of reactors may be used, particularly reactors with fluidized bed or with moving bed involving circulation of solid particles. It is also possible, when heating the charge by direct contact with the hot reducing gas, to make use of a reactor of the flash pyrolysis type, formed of a device for mixing the feed charges and an empty reaction chamber. The residence time of the reactants in the reactor is from 0.1 to 60 seconds, preferably from 0.5 to 20 seconds. Of course, the hydropyrolysis may be effected by using a purified hydrogen stream instead of the raw synthesis gas. However, the latter is preferred for the sake of its obvious economy.

The effluent from the hydropyrolysis reactor, discharged through line 11, is separated in the hydrocyclone 12 or in any other gas-solid separation apparatus, to a gaseous stream containing the produced hydrocarbons and a solid carbonaceous residue containing the ashes. A partial cooling of the gas may be effected before feeding this separator, while however avoiding the condensation of liquid hydrocarbons.

The carbonaceous residue is conveyed through line 13, as a dry solid or as a suspension in water, toward the reactor 17 for gasification by reaction with steam and oxygen, respectively introduced through lines 15 and 16. The gasification is preferably effected under a pressure substantially equal or slightly higher than that of the hydropyrolysis step, so as to permit the direct injection of the hot gases at a temperature of about 900° to 1500° C., into reactor 9 through lines 18 and 10, after at least partial separation of the ashes in separator 19. The latter are discharged through line 20. Any oxyvapogasification process providing for a good conversion rate of the carbonaceous material of the residue may be used, for example the systems with a fluidized bed, with a driven stream or a melting bath.

It is also possible to integrate in a single reactor the zones for hydropyrolysis of the coal-recycle oil charge and for the oxyvapogasification of the carbonaceous residue, for example with a system of circulating fluidized beds.

The hydropyrolysis gaseous effluent issued from the carbonaceous residue separator 12, through line 14, is cooled substantially to room temperature is exchanger 21 and separated in drum 22 to a gas stream essentially consisting of methane, ethane, hydrogen, carbon monoxide, carbon dioxide and hydrogen sulfide, discharged through line 23 and a liquid hydrocarbon stream discharged through line 24.

The gas stream is fractionated by known methods in absorber 25 to a stream of acid gases 26, containing carbon dioxide and hydrogen sulfide, and a stream 27 containing methane, ethane, hydrogen and carbon monoxide. This gas mixture may be fractionated cryogenically for recovering its constituents, separately or in admixture, and recycling at least a part of the hydrogen or carbon monoxide to the charge preheating stage 7. It is also possible to treat it over a catalyst for the hydrogenolysis of ethane and of the traces of other hydrocarbons to methane and the methanation of carbon monoxide to obtain a natural gas substitute essentially consisting of methane.

The liquid hydrocarbon stream conveyed through line 24 is expanded and separated in the distillation column 28 to a $C_3$–$C_4$ fraction (line 33), a light gasoline fraction containing a high proportion of benzene, toluene and xylenes, withdrawn through line 29, and a heavy fraction consisting mainly of polycyclic aromatic hydrocarbons which is fed through line 30 to the catalytic hydrogenation reactor 31, before being recycled through line 3 to the coal charge pasting zone. Additional hydrogen is introduced through line 32.

The hydrogenation is effected in the presence of catalysts of the type used for the hydrogenation, the hydrodesulfurization or the hydrocracking of petroleum fractions and containing, for example, Co, Mo, Ni and/or W compounds deposited on alumina, silica or silica-alumina carriers, used as a fixed, moving or ebullated bed. "Soluble" catalysts or catalysts finely dispersed in the charge, such as catalysts obtained by contacting a Mo, W, V, Ni, Co and/or Fe compound with a trialkylaluminum, can also be used. The severity of the treatment is so adjusted as to bring the atomic ratio H/C of the liquid to a value from 1 to 1.4, preferably from 1.05 to 1.25.

The operating conditions are usually a temperature from 300° to 450° C., a pressure from 50 to 150 bars, a hydrogen amount from 0.5 to 2 $Nm^3/kg$ of charge and a space velocity, calculated with respect to the liquid charge, from 0.1 to 2 volumes per volume per hour.

In an alternative embodiment, the order of column 28 and reactor 31 may be reversed in such a manner as to effect the catalytic hydrogenation on the total liquid fraction separated at 22, followed with a separation by distillation of the light gasoline fraction. It is also possible to separate by distillation, in addition to the gasoline cut, a middle distillate and to recycle to pasting only a higher fraction, for example one of initial distillation temperature higher than 220° C.

EXAMPLES 1 to 8

Comparative tests have been conducted in a laboratory unit to show that the hydropyrolysis of coal pasted in a recycle oil previously hydrogenated under the conditions according to the invention, leads to a much better yield of light hydrocarbons, mainly methane, ethane and benzene, and to a lower yield of solid carbonaceous residue than direct hyropyrolysis of the same coal.

Figure 2:
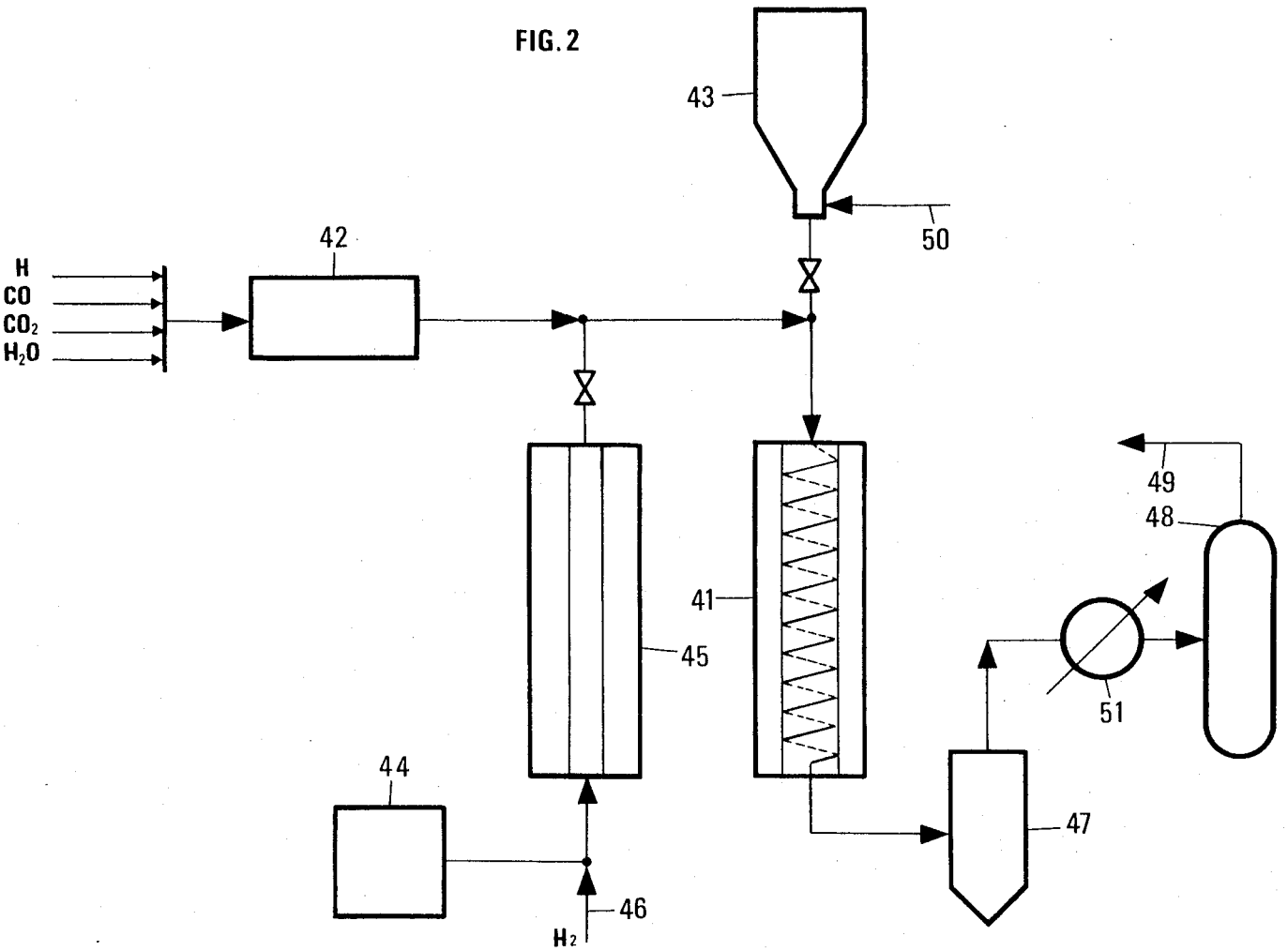
FIG. 2 is a schematic diagram of a laboratory unit used to conduct comparative tests of the present process and prior art processes.

The laboratory unit is shown in a simplified manner in FIG. 2.

It comprises a hydropyrolysis reactor 41 consisting of by a tube of a 3 mm inner diameter, wound on an electrically heated metal cylinder. Tubes of different length may also be used in order to obtain different residence times.

A system of pipes and valves is provided for introducing into this reactor:

On the one hand, a synthetic reducing gas containing by volume 33% of hydrogen, 33% of carbon monoxide, 17% of carbon dioxide and 17% of steam, preheated at 450° C. in oven 42.

On the other hand, either powdered coal through hopper 43 and a hydrogen stream 50 (case A), or a suspension or coal powder in a hydrogenated oil issued from a preceding operation (case B).

In this latter case, the suspension pumped from the reservoir 44 may be preheated in oven 45, in admixture with the hydrogen fed through line 46. The residence time of the suspension in the preheater is about 1 hour.

The products issued from reactor 41 pass through a solid particles separator 47, where is collected the ash-containing carbonaceous residue and, then, after cooling in condenser 51, through a liquid products collector 48. The gases escape through line 49 after expansion. The whole unit is operated under the same pressure, the pressure losses not being taken into consideration.

During the one to three hours period, all the products are recovered, measured and analyzed to establish the material balance of the operation. The liquid hydrocarbons recovered in collector 48 are fractionated by distillation to a light gasoline cut of boiling point lower than or equal to 150° C. and to a heavy cut usable to prepare the charge of another test.

The characteristics of the coal used are shown in Table I.

TABLE I

| | | | | | |
|---|---|---|---|---|---|
| Water % by weight | | | 2.2 | | |
| Ashes % by weight | | | 7.4 | | |
| Volatile material % by weight | | | 35 | | |
| Elementary analysis of the pure organic material (dry and without ash) | | | | | |
| | C | H | S | N | O |
| % by weight | 83.3 | 5.4 | 0.6 | 1.1 | 9.6 |
| Granulometry | | 0.05 to 0.1 mm | | | |

The operating conditions and the results of a few tests are reported in Table II. The yields to products are expressed in % by weight of the pure carbonaceous material (coal considered dry and ashless).

The oil used for suspending the coal particles in the tests of the case B type is issued from a mean batch of oil recovered during the preceding tests of carbon hydropryolysis, wherefrom the light gasoline fraction boiling below 150° C. has been withdrawn by distillation. This oil has been used as such (test 7) and after catalytic hydrogenation (tests 4, 5, 6, 8) at 380° C. under a pressure of 95 bars, in the presence of a nickel-tungsten on alumina catalyst.

The comparison of the results of tests 1, 2, 3, (case A) 4, 5, 6 (case B) and 9 (case C), shows that the coal hydropyrolysis, effected after preheating in a hydrogenated recycle oil (case B), leads to the formation of a much lower amount of solid carbonaceous residue than in the case of direct coal hydropyrolysis (case A) or of the mere heating in a hydrogenated recycle oil (case C).

The comparison of tests 5 and 7 shows that the previous hydrogenation of the pasting oil is necessary to noticeably decrease amount of the solid carbonaceous residue formed in the hydropyrolysis step.

The comparison of tests 5 and 8 shows that the preheating of the coal suspension in the hydrogenated oil must be effected in the recommended temperature range in order to obtain a noticeable decrease of the amount of solid carbonaceous residue formed in the hydropyrolysis step.

Finally, the comparison of tests 4, 5, 6 shows that the severity of the hydropyrolysis may be adjusted by regulating the temperature and/or the residence time, so as to produce substantially the same amount of heavy oil as used for suspending the coal. In this case (test 5), it can be considered that the totality of the light products come from the coal hydropyrolysis, so that the yield of coal conversion to light hydrocarbons ($C_1$ to $C_4$) and gasoline amounts to 76.3% by weight instead of 32.9% in the case of direct carbon hydropyrolysis under the same conditions.

TABLE II

| | CASE A | | | CASE B | | | | | CASE C |
|---|---|---|---|---|---|---|---|---|---|
| TEST NUMBER | 1 | 2 | 3 | 4 | 5 | 6 | 7 | 8 | 9 |
| Operating conditions | | | | | | | | | |
| Reducing gas (Nl/h) | 150 | 150 | 150 | 150 | 150 | 150 | 150 | 150 | 150 |
| Additional $H_2$ supply (line 46 or 50) (Nl/h) | 75 | 75 | 75 | 75 | 75 | 75 | 75 | 75 | 75 |
| Coal (calculated as dry, ashless coal) (g/h) | 100 | 100 | 100 | 100 | 100 | 100 | 100 | 100 | 100 |
| Recycle hydrogenated oil (g/h) | — | — | — | 120 | 120 | 120 | 120 | 120 | 120 |
| . H/C atomic ratio | — | — | — | 1.2 | 1.2 | 1.2 | 0.83 | 1.2 | 1.2 |
| . % by weight of the charge | — | — | — | 54.5 | 54.5 | 54.5 | 54.5 | 54.5 | 54.5 |

TABLE II-continued

| TEST NUMBER | CASE A 1 | 2 | 3 | CASE B 4 | 5 | 6 | 7 | 8 | CASE C 9 |
|---|---|---|---|---|---|---|---|---|---|
| Temperature of preheater 45 (°C.) | — | — | — | 450 | 450 | 450 | 450 | 200 | 450 |
| Maximum temperature of reactor 41 (°C.) | 720 | 755 | 850 | 720 | 755 | 850 | 755 | 755 | — |
| Pressure (bar) | 90 | 90 | 90 | 90 | 90 | 90 | 90 | 90 | 90 |
| Residence time in reactor 41 (sec) | 8 | 8 | 3 | 8 | 8 | 3 | 8 | 8 | — |
| Distribution of products in % by weight of the coal + oil charge | | | | | | | | | |
| $CH_4$ | 9.5 | 13.3 | 23.2 | 7.1 | 13.1 | 28.3 | 6.3 | 9.1 | 3.2 |
| $C_2$ | 9.1 | 11.2 | 12.8 | 8.2 | 11.4 | 18.6 | 6.5 | 8.6 | 1.1 |
| $C_3$–$C_4$ | 0.8 | 0.4 | 0.1 | 0.4 | 0.2 | 0.2 | 0.1 | 0.2 | 4 |
| Light gasoline <150° C. | 6.2 | 8 | 7.5 | 7.1 | 10 | 9.4 | 4.1 | 7.2 | 9.1 |
| of which benzene % b.w. | 82 | 87 | 93 | 83 | 88 | 94 | 86 | 86 | 15 |
| Heavy oil >150° C. | 13.5 | 12 | 9 | 65 | 54 | 32 | 63 | 55 | 59.7 |
| Solid carbonaceous residue | 60 | 54 | 45.8 | 11.4 | 10.2 | 12.7 | 19.1 | 17.7 | 19.5 |
| Distribution of the products in % b.w. of dry, ashless coal | | | | | | | | | |
| Solid carbonaceous residue | 60 | 54 | 45.8 | 25 | 22.4 | 28 | 42 | 39 | 43 |
| Light hydrocarbons ($CH_4$ + $C_2$, $C_3$, $C_4$ + gasoline) | 25.6 | 32.9 | 43.6 | | 76.3 | | | | 38.3 |

What is claimed is:

1. A process for converting a solid carbonaceous material to lower paraffinic hydrocarbons and monocyclic aromatic hydrocarbons, comprising the steps of:
   (a) admixing the carbonaceous material with a hydrogenated recycle oil, having an atomic ratio H/C of at least 1/1, obtained from step (e), and maintaining the resultant mixture in contact with a hydrogen-containing gas at a temperature from 350° to 470° C., for at least 5 minutes, under a hydrogen partial pressure of at least 20 bars;
   (b) contacting the effluent from step (a) without separation with a hydrogen-containing reducing gas for 0.1 to 60 seconds, at a temperature from 600° to 1000° C., under a pressure of at least 20 bars, said reducing gas being produced at least partly in step (d) and being introduced at a temperature of at least 900° C.;
   (c) fractionating the product of step (b), and separately recovering (i) at least one fraction of carbonaceous solid residue, (ii) at least one fraction of lower paraffinic hydrocarbons and monocyclic aromatic hydrocarbons normally distilling, at least in major part, below 150° C., and (iii) at least one hydrocarbon fraction normally distilling, at least in major part, above 150° C.;
   (d) treating the carbonaceous solid residue fraction (i) with oxygen and steam, under conditions of carbon oxyvapogasification, to convert at least a portion thereof to a hydrogen containing reducing gas, and feeding at least a portion of said reducing gas to step (b);
   (e) contacting hydrocarbon fraction (iii) from step (c) with hydrogen, in the presence of a hydrogenation catalyst, under hydrogenation conditions, until an atomic ratio H/C of the hydrocarbons of said fraction of at least 1/1 is obtained, and feeding at least a portion of the resultant hydrogenated hydrocarbon fraction back to step (a) as said hydrogenated recycle oil.

2. A process according to claim 1 wherein said hydrogen-containing gas in step (a) consists of a portion of the reducing gas produced in step (d).

3. A process according to claim 1, wherein the atomic ratio H/C of the hydrogenated oil obtained in step (e) and recycled to step (a) is from 1.05 to 1.25, and the ratio by weight recycle oil/carbonaceous material in step (a) is from 0.5:1 to 5:1.

4. A process according to claim 1, wherein a catalyst containing at least one vanadium, tungsten, molybdenum, iron, cobalt and/or nickel compound is present in step (a).

5. A process according to claim 1, wherein in step (b); said contacting is effected for 0.5 to 20 seconds, the temperature being from 650° to 800° C.

6. A process according to claim 1, wherein the reducing gas used in step (b) is the raw reducing gas produced in step (d) and said gas is introduced at a temperature of from 900° to 1500° C.

7. A process according to claim 1, wherein the conditions of the process steps are so selected as to produce an amount of fraction (iii) in step (c) substantially equal to the amount of recycle oil used in step (a).

8. A process according to claim 6, wherein in step (b), the reactor temperature is maintained within said range of 600° to 1000° C. by regulation of the temperature and feed rates of said effluent from step (a) and said raw reducing gas.

9. A process for converting a solid carbonaceous material to lower paraffinic hydrocarbons and monocyclic aromatic hydrocarbons, comprising the steps of:
   (a) admixing the carbonaceous material with a hydrogenated recycle oil, having an atomic ratio H/C of at least 1/1, obtained from step (f), and maintaining the resultant mixture in contact with a hydrogen-containing gas at a temperature from 350° to 470° C., for at least 5 minutes, under a hydrogen partial pressure of at least 20 bars;
   (b) contacting the effluent from step (a), without separation with a hydrogen-containing reducing gas for 0.1 to 60 seconds, at a temperature from 600° to 1000° C., under a pressure of at least 20 bars, said reducing gas being produced at least partly in step (d) and being introduced at a temperature of at least 900° C.;
   (c) separating the effluent from step (b) into (i) at least one fraction of solid carbonaceous residue, and (ii) a liquid hydrocarbon phase;
   (d) treating the carbonaceous solid residue (i) from step (c) with oxygen and steam, under conditions of carbon oxyvapogasification, to convert at least a portion thereof to a hydrogen-containing reducing gas, and feeding at least a portion of said reducing gas to step (b);
   (e) contacting the liquid hydrocarbon phase (ii) from step (c) with hydrogen, in the presence of a hydrogenation catalyst, under hydrogenation conditions, until an atomic ratio H/C of the hydrocarbons of said fraction of at least 1/1 is obtained; and (f) fractionating the hydrogenated hydrocarbon effluent from step (e), and separately recovering (iii) a fraction of lower paraffinic hydrocarbons and monocyclic aromatic hyrocarbons normally distilling, at least in major part, below 150° C., and (iv) a hydrocarbon fraction normally distilling, at least in major part, above 150° C., and feeding at least a portion of said recovered hydrocarbon fraction (iv) back to step (a) as said hydrogenated recycle oil.

10. A process according to claim 9, wherein said hydrogen-containing gas in step (a) consists of a portion of the reducing gas produced in step (d).

11. A process according to claim 9, wherein the atomic ratio H/C of the hydrogenated oil obtained in step (f) and recycled to step (a) is from 1.05 to 1.25, and the ratio by weight recycle oil/carbonaceous material in step (a) is from 0.5:1 to 5:1.

12. A process according to claim 9, wherein a catalyst containing at least one vanadium, tungsten, molybdenum, iron, cobalt and/or nickel compound is present in step (a).

13. A process according to claim 9, wherein in step (b), said contacting is effected for 0.5 to 20 seconds, the temperature being from 650° to 800° C.

14. A process according to claim 9, wherein the reducing gas used in step (b) is the raw reducing gas produced in step (d), and said gas is introduced at a temperature of from 900° to 1500° C.

15. A process according to claim 14, wherein in step (b), the reactor temperature is maintained within said range of 600° to 1000° C. by regulation of the temperature and feed rates of said effluent from step (a) and said raw reducing gas.

* * * * *